US010547932B2

(12) United States Patent
Proos

(10) Patent No.: US 10,547,932 B2
(45) Date of Patent: Jan. 28, 2020

(54) WEARABLE AUDIO SYSTEM

(71) Applicant: Bluewire Audio LLC, Northborough, MA (US)

(72) Inventor: Andrew Proos, Northborough, MA (US)

(73) Assignee: Bluewire Audio LLC, Northborough, MA (US)

( * ) Notice: Subject to any disclaimer, the term of this patent is extended or adjusted under 35 U.S.C. 154(b) by 0 days.

(21) Appl. No.: 16/173,826

(22) Filed: Oct. 29, 2018

(65) Prior Publication Data

US 2019/0174214 A1 Jun. 6, 2019

Related U.S. Application Data

(60) Provisional application No. 62/581,943, filed on Nov. 6, 2017.

(51) Int. Cl.
*H04R 1/10* (2006.01)
*H04R 1/02* (2006.01)

(52) U.S. Cl.
CPC ..... *H04R 1/105* (2013.01); *H04R 1/025* (2013.01); *H04R 1/1008* (2013.01); *H04R 1/1033* (2013.01); *H04R 1/1091* (2013.01); *H04R 1/023* (2013.01); *H04R 1/028* (2013.01); *H04R 2201/023* (2013.01); *H04R 2420/07* (2013.01)

(58) Field of Classification Search
CPC ..... H04R 1/105; H04R 1/025; H04R 1/1008; H04R 2201/023
See application file for complete search history.

(56) References Cited

U.S. PATENT DOCUMENTS 6,168,286 B1 * 1/2001 Duffy ..... A42B 1/242 362/105
6,301,367 B1 * 10/2001 Boyden ..... A42B 1/245 2/209
2008/0298608 A1 * 12/2008 Wilcox ..... H03F 3/20 381/120
2012/0099755 A1 * 4/2012 Hu ..... H04R 1/1066 381/380
2013/0180031 A1 * 7/2013 Bullock ..... A42B 1/067 2/209.13
2014/0192996 A1 * 7/2014 Wilcox ..... H04M 1/05 381/77
2015/0296285 A1 10/2015 Proos et al.
2016/0073200 A1 * 3/2016 Yoo ..... H04R 5/0335 381/311

* cited by examiner

*Primary Examiner* — Mark Fischer
(74) *Attorney, Agent, or Firm* — Brian M. Dingman; Dingman IP Law, PC

(57) ABSTRACT

An audio system that is constructed and arranged to be carried by headwear, such as a cap, that has a crown with a lower edge. The audio system has two sound delivery assemblies that are constructed and arranged to deliver sound from a sound-delivery outlets thereof, and a clip for each sound delivery assembly, each clip constructed and arranged to be removably coupled to the lower edge of the crown of the headwear to allow the outlets of the sound delivery assemblies to be located proximate the ear.

20 Claims, 8 Drawing Sheets

WEARABLE AUDIO SYSTEM

CROSS-REFERENCE TO RELATED APPLICATION

This application claims priority of Provisional Patent Application 62/581,943 filed on Nov. 6, 2017.

BACKGROUND

This application relates to an audio system.

Runners, walkers, and others who are outside often desire to listen to audio. It is sometimes desirable and safer for the user to be able to hear environmental sounds at the same time as the audio.

SUMMARY

Featured in this disclosure is a wearable audio system that is constructed and arranged to be carried by a hat or other headwear such as a cap, a visor, a headband, or a helmet (such as a bicycle helmet). In the non-limiting example shown in the drawings, the headwear is a cap, such as a baseball-type cap that has a crown that sits on the head. The audio system is similar to the audio system disclosed in patent application Ser. No. 14/686,840 (US 2015/0296285), the disclosure of which is incorporated herein by reference. The audio system includes two sound delivery assemblies, such as those disclosed in the application incorporated herein. The audio system further includes a bracket or clip for each sound delivery assembly and a wire harness that connects the sound delivery assemblies to a connector that may be coupled to an audio device. The clip is constructed and arranged to be removably coupled to the lower edge of the crown of the cap, or to an edge of another style of headwear. This allows the sound delivery assemblies to be carried securely by the headwear, with the sound outlets of the sound delivery assemblies located just above the ear, and the wire harness contained within the confines of the headwear.

In one aspect, an audio system that is constructed and arranged to be carried by headwear that has a crown with a lower edge includes two sound delivery assemblies that are constructed and arranged to deliver sound from a sound-delivery outlets thereof, and a clip for each sound delivery assembly, each clip constructed and arranged to be removably coupled to the lower edge of the crown of the headwear to allow the outlets of the sound delivery assemblies to be located proximate the ear.

Examples may include one of the above and/or below features, or any combination thereof. The clip may comprise a flexible formed wire member that has two outside legs and an inner, generally arc-shaped portion. The clip legs may have distal ends. The clip may further comprise a crosspiece located over the distal ends of the legs.

Examples may include one of the above and/or below features, or any combination thereof. The audio system may further comprise a wiring harness comprising a splitter that is constructed and arranged to be located inside of the crown of the headwear, and two audio wires, one running from each sound delivery assembly to the splitter. Each audio wire may be located between a crosspiece and the inside of the crown of the headwear. The headwear may have a reinforced opening in the crown, and the splitter may be located inside the crown proximate the reinforced opening. The splitter may be larger than the reinforced opening, to inhibit the audio wires from being pulled through the opening and out of the headwear. The crosspiece may comprise end prominences that retain the audio wire in place between the crosspiece and the inside of the crown of the headwear and direct the audio wires toward the top of the crown.

Examples may include one of the above and/or below features, or any combination thereof. The sound delivery assemblies may each comprise a housing with a sound-emitting opening. The sound delivery assemblies may each further comprise a clip interface that comprises a generally circular raised boss standoff portion that carries a larger disc retention feature. The standoff may have a diameter that is about equal to a greatest inner diameter of the arc-shaped portion of the wire member, to allow the arc-shaped portion to be pushed onto the standoff. The retention feature may overlie the arc-shaped portion of the wire member.

Examples may include one of the above and/or below features, or any combination thereof. A waterproof interior cavity may be located between the standoff and the retention feature, to provide a waterproof space for electrical connection between an audio wire and leads from an audio driver of the audio delivery assembly. The audio system may further comprise a septum that divides the interior cavity to prevent contact between the leads. The sound delivery assembly may further comprise an audio wire strain relief extension member that projects from the standoff, where the audio wire runs through the extension member. The extension member may also function as a rotation stop for rotation of the sound delivery assembly on the clip.

Examples may include one of the above and/or below features, or any combination thereof. Each sound delivery assembly may comprise an audio driver mounted in a near-vertical position in the housing to direct sound downward into an audio channel while also minimizing the thickness of the housing. The audio driver may have a front side and a rear side, and there may also be a baffle member located between the rear side of the audio driver and the housing, to inhibit rear side sound from interfering with the sound that is delivered into the audio channel. Each sound delivery assembly may be constructed and arranged to rotate on the clip, to allow the user to optimize the position of the sound-emitting opening.

DETAILED DESCRIPTION

Figure 1B:
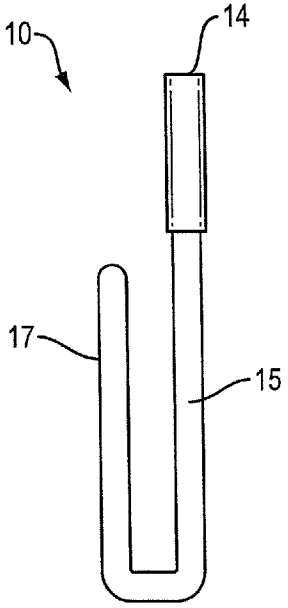
FIGS. 1A and 1B are front and side views of a clip for an audio system.
Figure 1A:
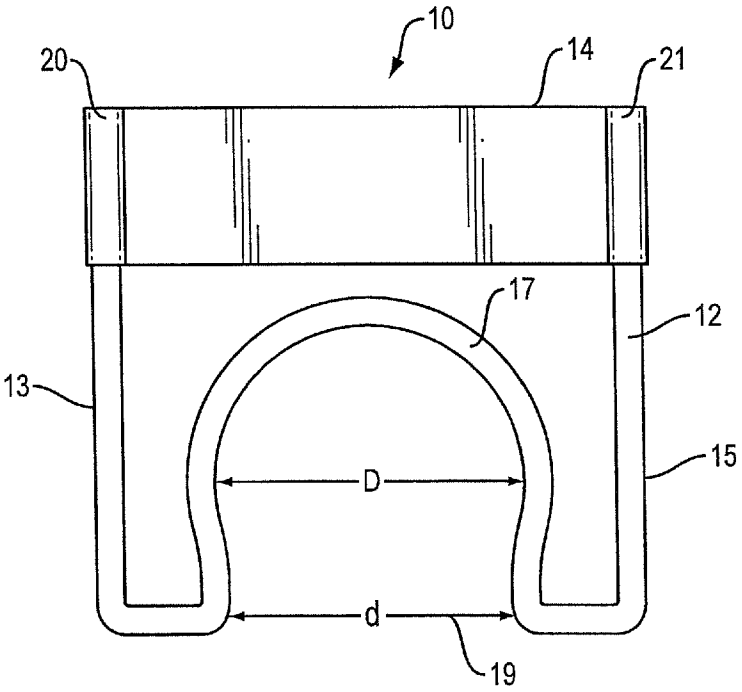

The clip is shown in FIGS. 1A and 1B. Clip 10 includes flexible formed wire member 12 that has outside legs 13 and 15 and inner generally arc-shaped portion 17. Cross-piece 14 fits over the top (distal) ends of legs 13 and 15 at end portions 20 and 21, respectively. A function of cross-piece 14 is to stabilize the two legs of the clip and to present an articulating surface that squeezes the lower edge of the headwear between itself and the disc retention feature 35, which is described below. The clip is designed with an appropriate degree of 'spring' to allow the units to attach securely to caps/hats/headwear with different thicknesses at the articulating edge.

The clip can be removeable from both the headwear and the sound delivery system, though the latter is not necessary as more likely the clip will be slid onto the clip interface 31 at initial assembly, but not removed from the sound delivery assembly thereafter. Accordingly, the clip does not necessarily need to be removable from the sound delivery assembly, and so could be constructed and coupled to the sound delivery assembly differently than as shown and described.

Figure 2B:
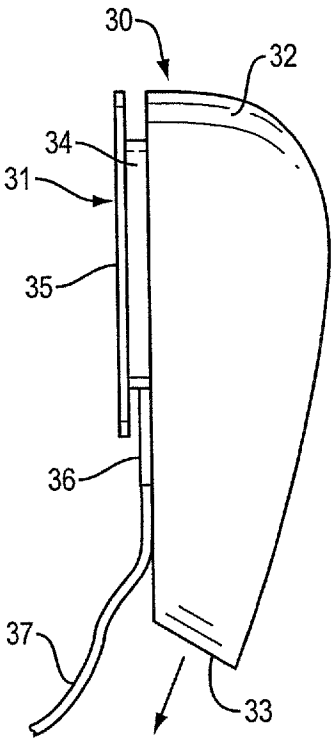
FIGS. 2A, 2B, 2C and 2D are rear, side, rear partially disassembled and cross-sectional views, respectively, of a sound delivery assembly for an audio system.
Figure 2A:
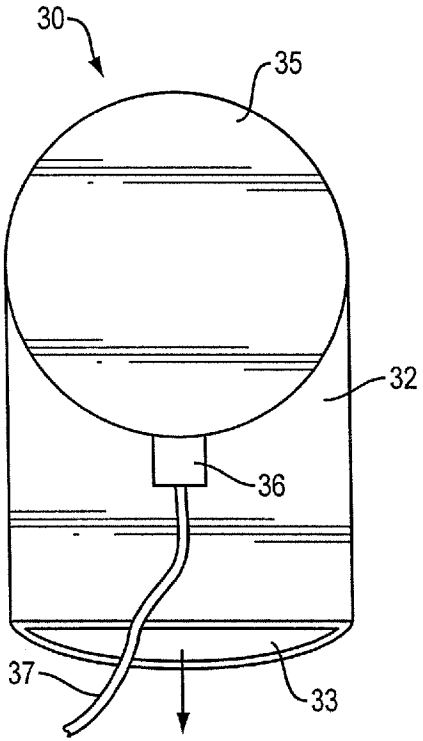
Figure 2D:
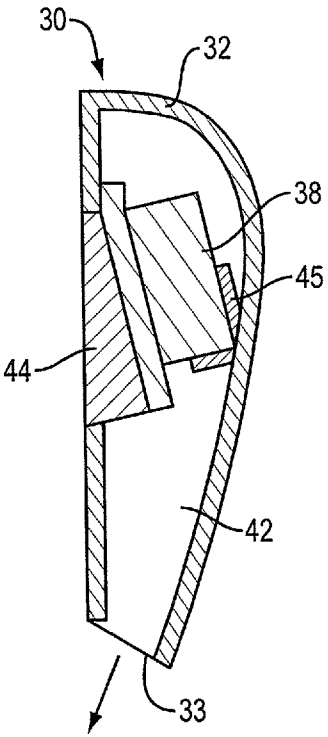
Figure 2C:
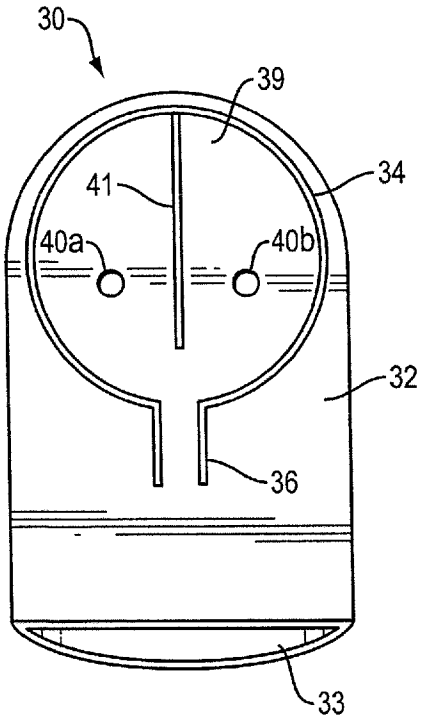

The sound delivery assembly is shown in FIGS. 2A, 2B, 2C and 2D, where FIG. 2A is a rear view, FIG. 2B is a side view, FIG. 2C is a rear view with the disc retention feature 35 removed, and FIG. 2D is a vertical cross-section of the housing 32 and the audio driver and driver mount that are inside of the housing.

Sound delivery assembly 30 includes generally hollow housing 32 as well as an integral clip interface 31 that articulates with the clip 10. The inner aspect of housing 32 is comprised of an audio channel that conducts sound from the front side of a full range audio driver mounted at the top of the audio channel. The audio driver 38 is mounted facing toward the user's head and directs sound downward into the audio channel 42 and toward the sound-emitting opening 33. The driver mount 44 holds the audio driver 38 in a near vertical orientation in order to minimize the required thickness of the housing 32 and reduce the profile of the audio system when mounted on headwear. There can be appropriate acoustical insulation (not shown) inside the audio channel 42 of the sound delivery assembly in order to optimize the quality of audio output. Compressible baffle member 45 can be located between the rear side of driver 38 and the inside of housing 32 to seal sound from the rear of the driver from entering channel 42 and interfering with the sound from the front of the driver that enters channel 42. If there are openings in the rear of driver 38, baffle member 45 can be designed to fully or partially cover the openings, to further inhibit rear sound from escaping into channel 42.

The clip interface 31 comprises circular boss 34 that carries larger, overlying, generally circular disc retention feature 35. Boss 34 has an outer diameter that is about equal to the greatest inner diameter "D" of portion 17 of member 12. This allows portion 17 to be pushed onto circular boss 34. Opening 19 of portion 17 can have a diameter "d" which is less than "D." The springiness of portion 17 allows it to be pushed on and over interface 31 and seat on it, so that sound delivery assembly 30 will be retained on clip 10. Retention feature 35 then overlies clip portion 17 to help retain sound delivery assembly 30 on clip 10 while preserving the ability to rotate the sound delivery assembly to obtain optimal positioning of the sound-emitting opening 33 proximate to the user's ear.

An interior, generally cylindrical, cavity 39 located inside of circular boss 34 and below disc retention feature 35 functions to provide a waterproof space for electrical connection between audio wires 37*a*, 37*b* (FIG. 4) and the electrical leads from the audio driver 38 located in the housing. Boss extension legs 36 directs and provides strain relief to audio wire 37 that passes through extension 36 and enters the interior cavity 39. Two small apertures 40*a*, 40*b* allow passage of the electrical leads (not shown) from the audio driver 38 from the audio channel 42 into the interior cavity 39 where they can be attached to audio wire 37. A vertical septum 41 divides the interior cavity and prevents contact (short-circuit) between the wires. Boss extension 36 also functions as a stop to limit the extent of rotation of the sound delivery assembly 30 on clip 10.

Figure 3:
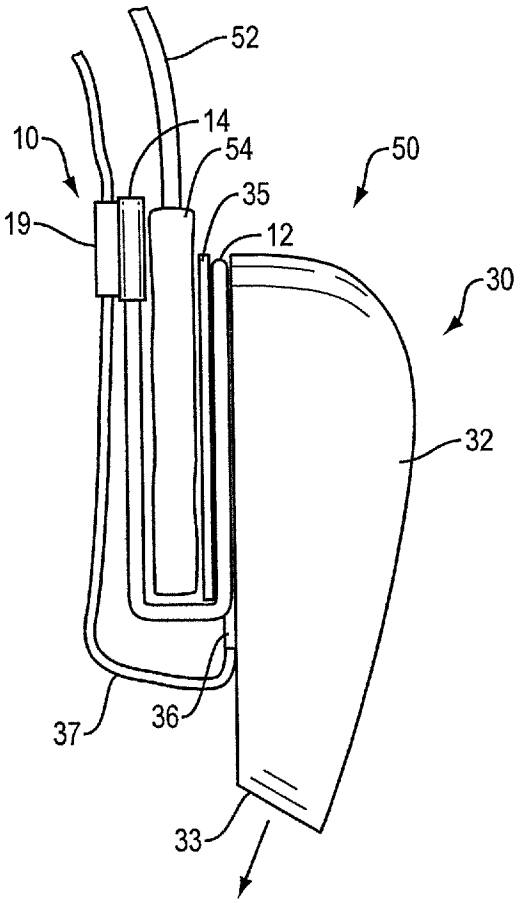
FIG. 3 is a partial side view of a speaker assembly for an audio system.

The speaker assembly 50 comprised of clip 10 and sound delivery assembly 30 is shown in FIG. 3. Clip 10 is constructed and arranged to be fitted over the lower reinforced (thickened) edge 54 of hat crown 52, as shown in FIG. 3. This places sound emitting opening 33 just below the lower edge of the hat. The speaker assembly 50 can be fastened where desired along the extent (length) of the hat lower edge 54, and the sound delivery unit 30 can be rotated on the clip 10 to optimally locate the sound-emitting opening proximate to the ear. The 'spring' in the clip 10 allows the speaker assembly 50 to articulate with headwear that has varying thickness at the lower edge 54. Also, since the clips accomplish a removable coupling of the sound delivery assembly to headwear, the audio system can be used with more than one cap, hat or other type of headwear.

Figure 4:
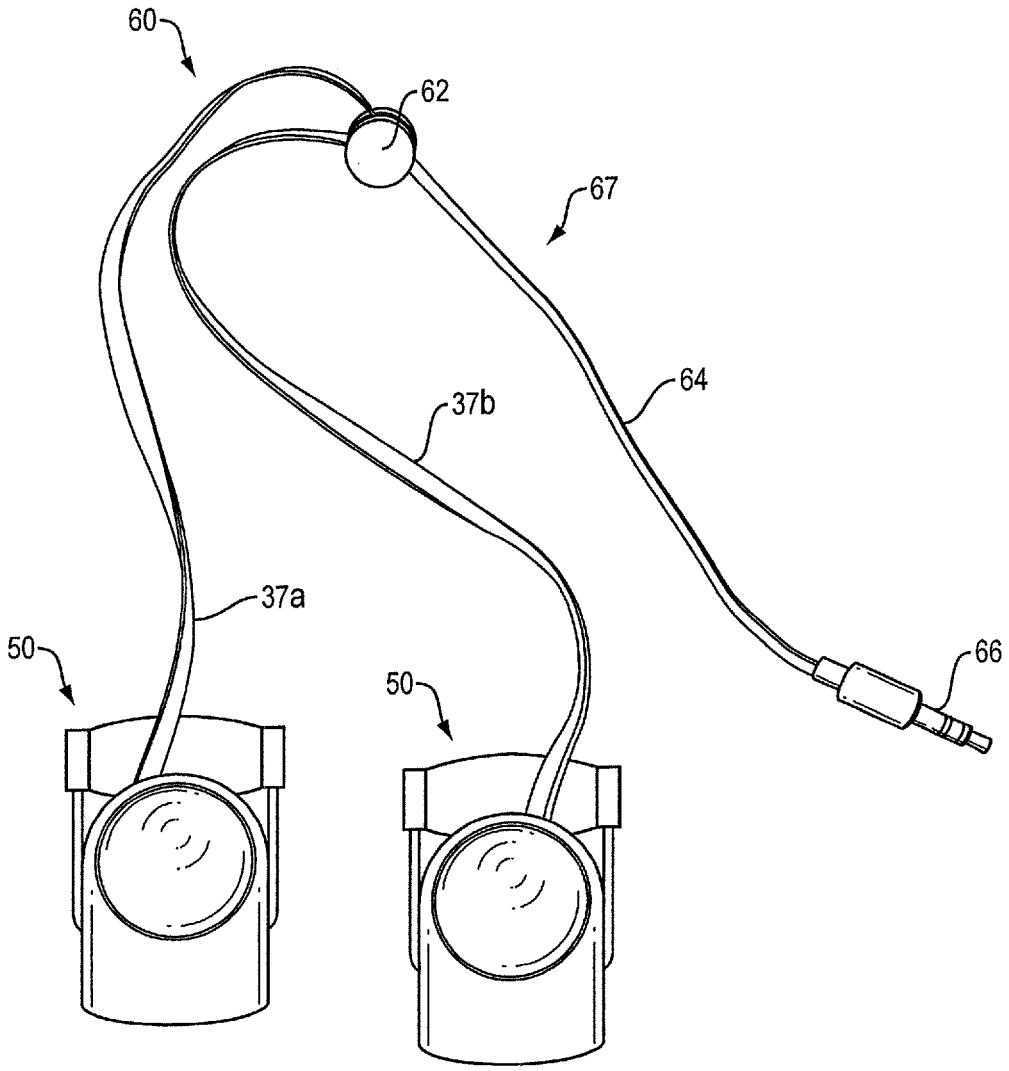
FIG. 4 illustrates a wearable audio system.

FIG. 4 illustrates wearable audio system 60 comprising two speaker assemblies 50 and audio wire harness 67. Audio wire harness 67 includes connector 66 that is adapted to be coupled to an audio source, such as a Bluetooth receiver or an MP3 player. Common cable 64 connects the connector 66 with a splitter 62 that splits the audio signal into channel A and B which are conducted through audio wires 37*a* and 37*b*.

Figure 6:
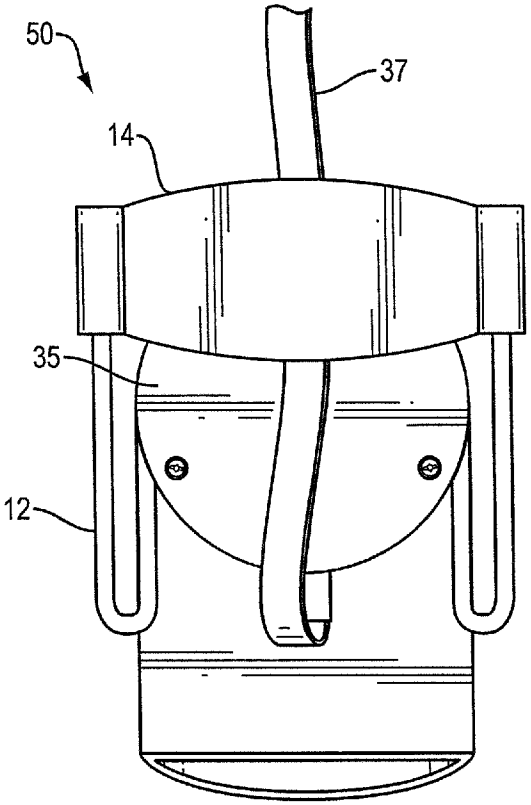
FIG. 6 illustrates aspects of a wearable audio system.
Figure 5:
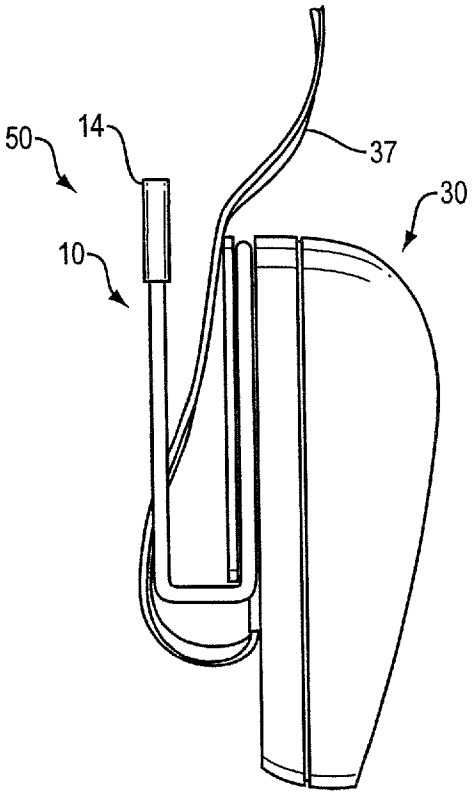
FIG. 5 illustrates aspects of a wearable audio system.

FIG. 5 illustrates the wearable audio system 60 showing a speaker assembly 50 and a portion of audio wire 37. FIG. 6 illustrates the back side of wearable audio system 60. After exiting boss extension 36, audio wire 37 passes under the lower edge 54 of the headwear and turns up to pass in between the crosspiece 14 and the inner aspect of the hat. Audio wire 37 is prevented from slipping out from under the crosspiece 14 by thickened portions 20 and 21 that receive the legs on either side of part 14.

Figure 7:
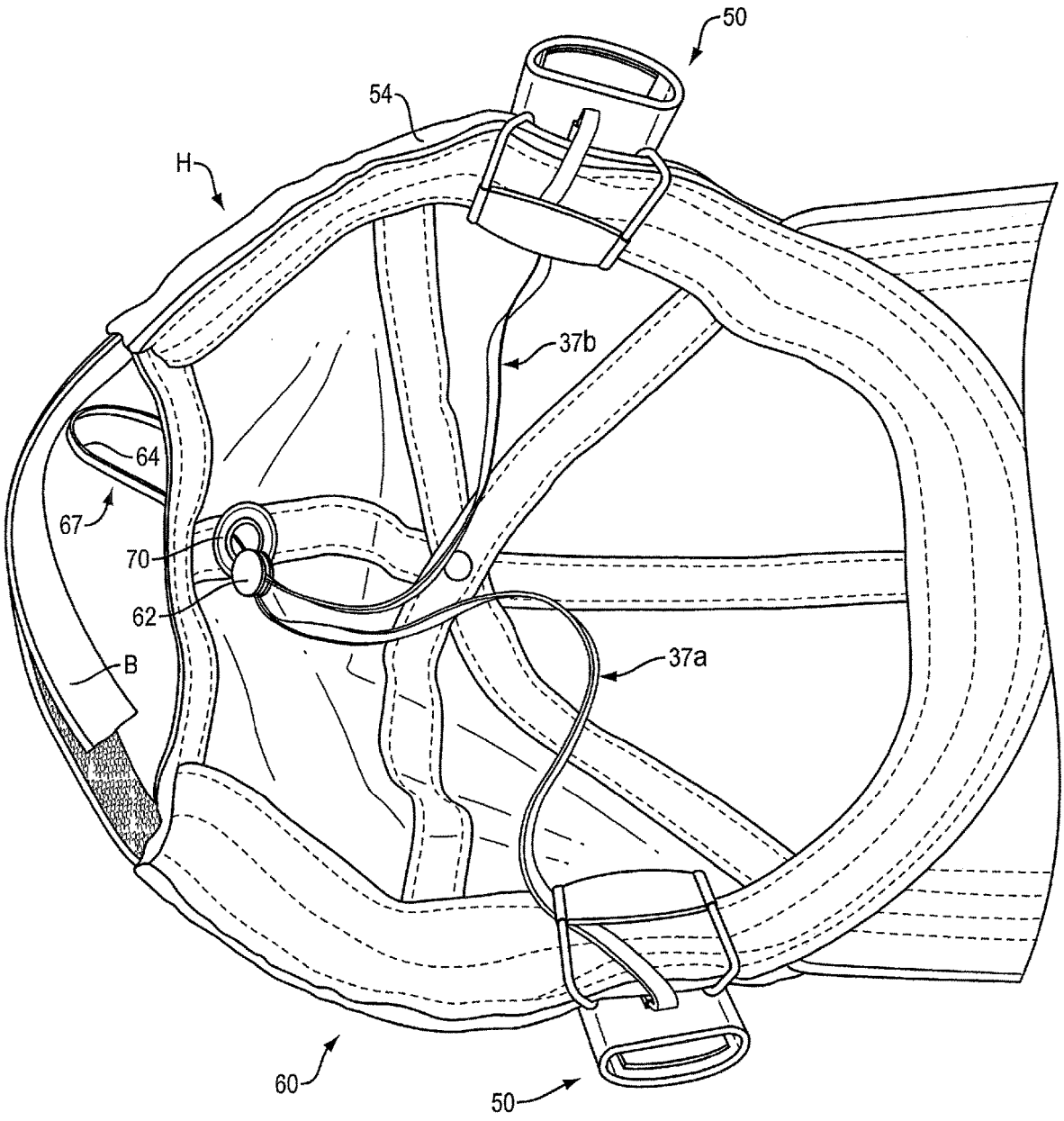
FIG. 7 illustrates a wearable audio system mounted to a hat.

FIG. 7 illustrates the inside of hat "H" to which wearable audio system 60 has been coupled, showing both speaker assemblies 50 and audio wire harness 67. Common cable 64 passes through grommet 70 to exit to the outside of the headwear where connector 66 may be plugged into an audio source that has been attached to the headwear. The common cable may also pass through the opening above the adjustable (or non-adjustable) band "B" of a non-customized hat. Splitter 62 has a larger diameter than the opening of grommet 70 and prevents the audio wires 37*a*, 37*b* from being pulled further out of the hat. The length of the audio wires 37*a*, 37*b* along with the size and location of the splitter 62 and the retention action of crosspiece 14 combine to keep the electrical wires inside the crown of the hat, which is one of the benefits of the disclosed design.

Figure 8:
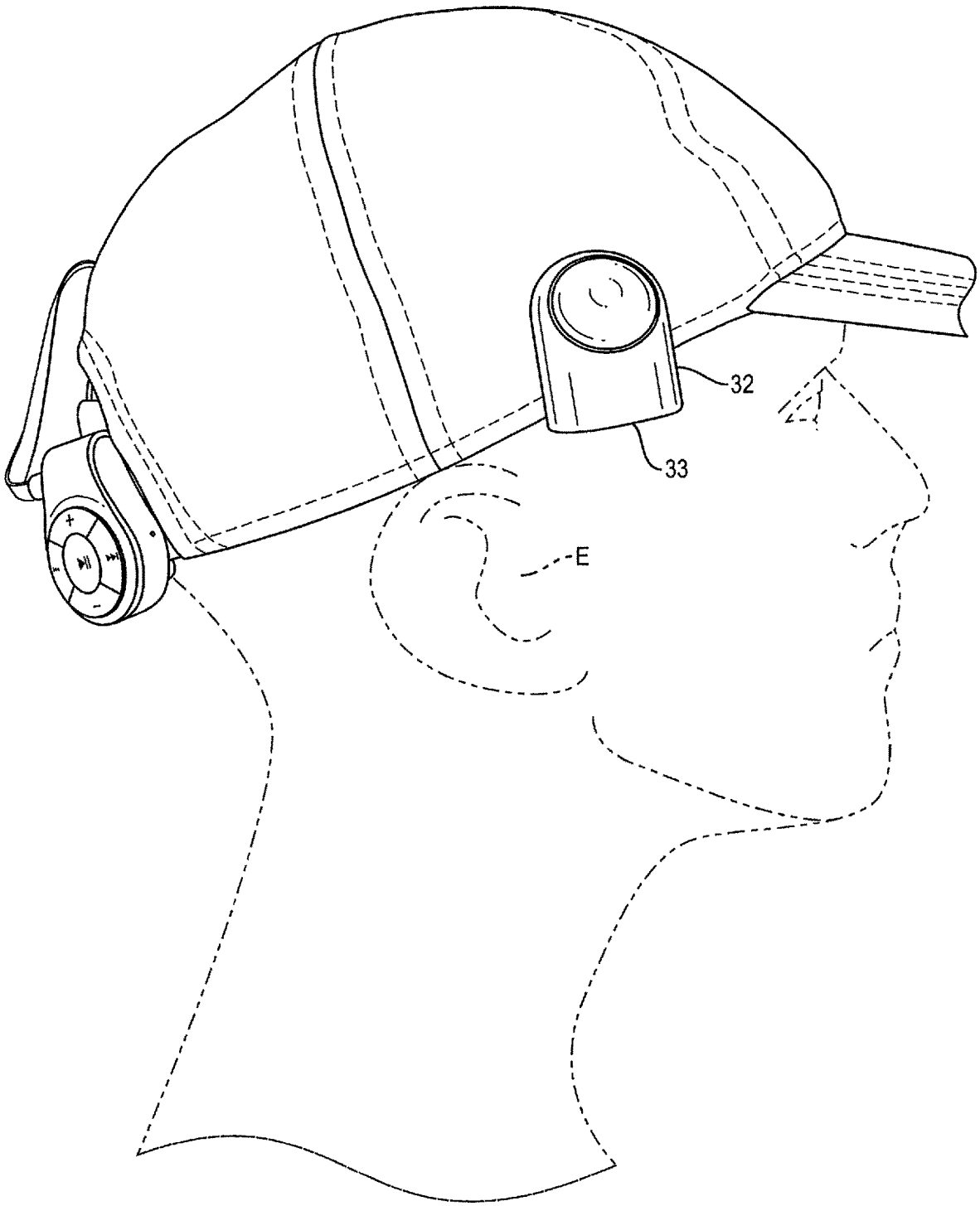
FIG. 8 illustrates a wearable audio system mounted to a hat.

FIG. 8 is a side view showing a location of housing 32 and sound-emitting opening 33 that delivers sound to ear "E." The location of the sound-emitting opening 33 proximate to (but not in or over) the ear enhances safety by preserving ambient sound.

Figure 9:
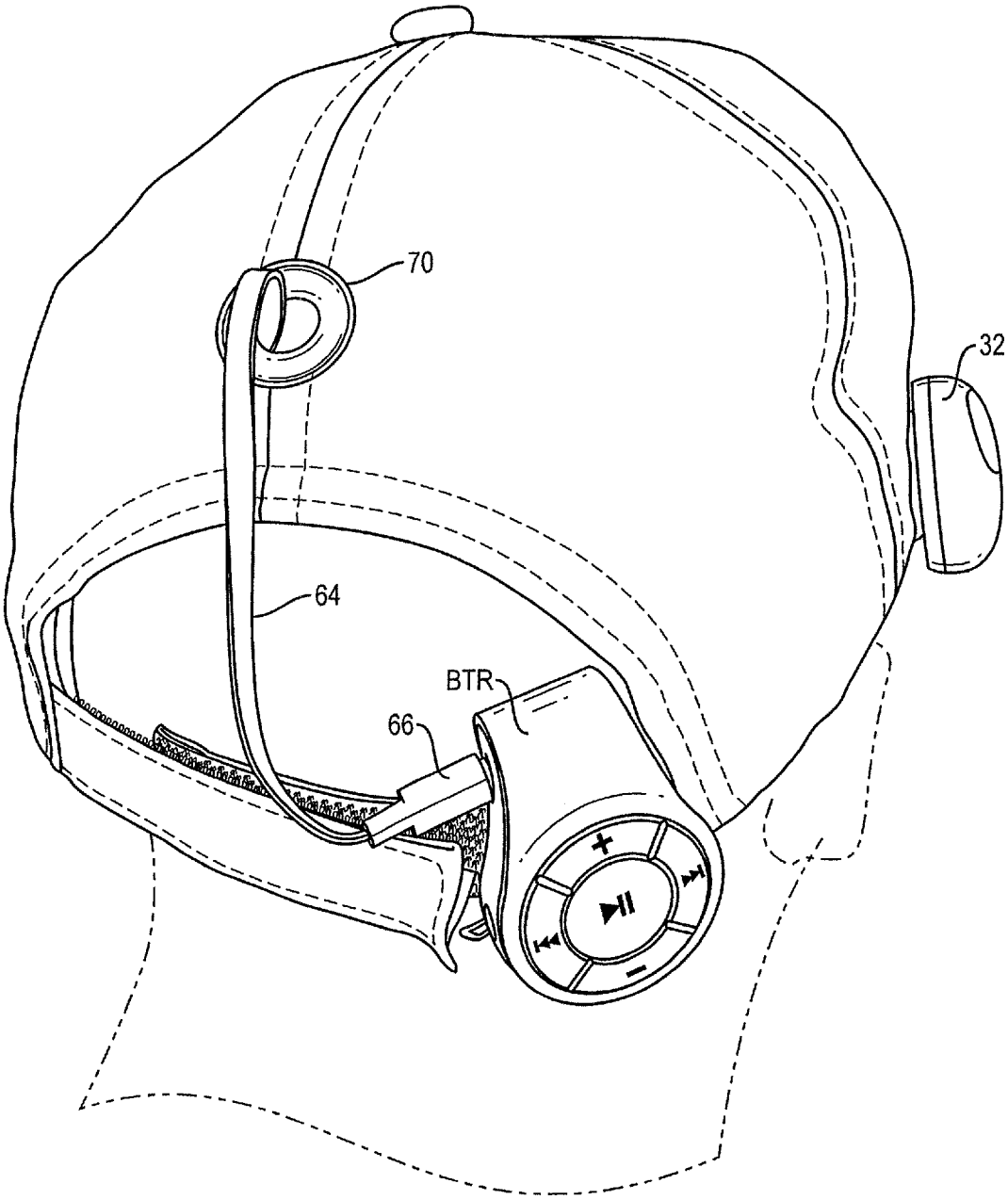
FIG. 9 illustrates a wearable audio system mounted to a hat.

FIG. 9 is a rear view showing a location of housing 32 and a routing of common cable 64 which exits from the interior of the hat crown through grommet 70. Connector 66 is shown coupled with a Bluetooth receiver "BTR" of a type that can be mounted to the hat. All aspects of wearable speaker system 60 are securely mounted on or contained within the headwear in order to enhance user convenience by eliminating loose wires and any need for repositioning of the units during active use.

A number of implementations have been described. Nevertheless, it will be understood that additional modifications may be made without departing from the scope of the inventive concepts described herein, and, accordingly, other examples are within the scope of the following claims.

What is claimed is:

1. An audio system that is constructed and arranged to be carried by headwear that has a crown with a lower edge, comprising:

two sound delivery assemblies that are constructed and arranged to deliver sound from a sound-delivery outlets thereof;

a clip for each sound delivery assembly, the clip having legs with distal ends; and a crosspiece located over the distal ends of the legs;

wherein each clip constructed and arranged to be removably coupled to the lower edge of the crown of the headwear, to allow the outlets of the sound delivery assemblies to be located proximate an ear.

2. The audio system of claim 1, wherein the clip comprises a flexible formed wire member that has two outside legs and an inner, generally arc-shaped portion.

3. The audio system of claim 2, further comprising a wiring harness comprising a splitter that is constructed and arranged to be located inside of the crown of the headwear, and two audio wires, one running from each sound delivery assembly to the splitter.

4. The audio system of claim 3, wherein each audio wire is located between a crosspiece and the inside of the crown of the headwear.

5. The audio system of claim 4, wherein the headwear has a reinforced opening in the crown, and wherein the splitter is located inside the crown proximate the reinforced opening.

6. The audio system of claim 5, wherein the splitter is larger than the reinforced opening, to inhibit the audio wires from being pulled through the opening and out of the headwear.

7. The audio system of claim 4, wherein the crosspiece comprises end prominences that retain the audio wire in place between the crosspiece and the inside of the crown of the headwear and direct the audio wires toward the top of the crown.

8. The audio system of claim 2, wherein the sound delivery assemblies each comprise a housing with a sound-emitting opening.

9. The audio system of claim 8, wherein the sound delivery assemblies each further comprise a clip interface that comprises a generally circular raised boss standoff portion that carries a larger disc retention feature.

10. The audio system of claim 9, wherein the standoff has a diameter that is about equal to a greatest inner diameter of the arc-shaped portion of the wire member, to allow the arc-shaped portion to be pushed onto the standoff.

11. The audio system of claim 10, wherein the retention feature overlies the arc-shaped portion of the wire member.

12. The audio system of claim 9, wherein a waterproof interior cavity is located between the standoff and the retention feature, to provide a waterproof space for electrical connection between an audio wire and leads from an audio driver of the audio delivery assembly.

13. The audio system of claim 12, further comprising a septum that divides the interior cavity to prevent contact between the leads.

14. The audio system of claim 12, wherein the sound delivery assembly further comprises an audio wire strain relief extension member that projects from the standoff, where the audio wire runs through the extension member.

15. The audio system of claim 14, wherein the extension member also functions as a rotation stop for rotation of the sound delivery assembly on the clip.

16. The audio system of claim 8, wherein each sound delivery assembly comprises an audio driver mounted in a near-vertical position in the housing to direct sound downward into an audio channel while also minimizing the thickness of the housing.

17. The audio system of claim 16, wherein the audio driver has a front side and a rear side, further comprising a baffle member located between the rear side of the audio driver and the housing, to inhibit rear side sound from interfering with the sound that is delivered into the audio channel.

18. The audio system of claim 8, wherein each sound delivery assembly is constructed and arranged to rotate on the clip, to allow the user to optimize the position of the sound-emitting opening.

19. An audio system that is constructed and arranged to be carried by headwear that has a crown with a lower edge, comprising:

two sound delivery assemblies that are constructed and arranged to deliver sound from a sound-delivery outlets thereof, wherein the sound delivery assemblies each comprise a housing with a sound-emitting opening and a clip interface that comprises a generally circular raised boss standoff portion that carries a larger disc retention feature, wherein each sound delivery assembly comprises an audio driver mounted in a near-vertical position in the housing to direct sound downward into an audio channel while also minimizing the thickness of the housing, wherein the audio driver has a front side and a rear side, further comprising a baffle member located between the rear side of the audio driver and the housing, to inhibit rear side sound from interfering with the sound that is delivered into the audio channel; and a clip for each sound delivery assembly, each clip constructed and arranged to be removably coupled to the lower edge of the crown of the headwear, to allow the outlets of the sound delivery assemblies to be located proximate the ear, wherein the clip comprises a flexible formed wire member that has two outside legs and an inner, generally arc-shaped portion; wherein the standoff has a diameter that is about equal to a greatest inner diameter of the arc-shaped portion of the wire member, to allow the arc-shaped portion to be pushed onto the standoff, wherein the retention feature overlies the arc-shaped portion of the wire member, and wherein each sound delivery assembly is constructed and arranged to rotate on the clip, to allow the user to optimize the position of the sound-emitting opening.

20. An audio system that is constructed and arranged to be carried by headwear that has a crown with a lower edge, comprising:

two sound delivery assemblies that are constructed and arranged to deliver sound from sound-delivery outlets thereof;

a clip for each sound delivery assembly, the clip having legs with distal ends; and a crosspiece located over the distal ends of the legs;

wherein each clip constructed and arranged to be removably coupled to the lower edge of the crown of the headwear, to allow the outlets of the sound delivery assemblies to be located proximate an ear;

wherein the clip comprises a flexible formed wire member that has an inner, generally arc-shaped portion;

wherein the sound delivery assemblies each comprise a housing with a sound-emitting opening; and wherein the sound delivery assemblies each further comprise a clip interface that comprises a generally circular raised boss standoff portion that carries a larger disc retention feature.

* * * * *